US007401998B2

(12) United States Patent
Wilson et al.

(10) Patent No.: US 7,401,998 B2
(45) Date of Patent: Jul. 22, 2008

(54) CONSTRUCTION OF A FOAMED POLYMERIC MANHOLE CHIMNEY

(75) Inventors: Stephen K. Wilson, Royal Oak, MI (US); David Wahl, Bloomfield Hills, MI (US)

(73) Assignee: David M. Wahl, Bloomfield Hills, MI (US)

( * ) Notice: Subject to any disclaimer, the term of this patent is extended or adjusted under 35 U.S.C. 154(b) by 451 days.

(21) Appl. No.: 11/179,272

(22) Filed: Jul. 12, 2005

(65) Prior Publication Data

US 2006/0078382 A1 Apr. 13, 2006

Related U.S. Application Data

(60) Provisional application No. 60/610,577, filed on Sep. 16, 2004.

(51) Int. Cl.
*E02D 29/14* (2006.01)

(52) U.S. Cl. ..... 404/26; 52/20

(58) Field of Classification Search ..... 404/25, 404/26; 52/19, 20
See application file for complete search history.

(56) References Cited

U.S. PATENT DOCUMENTS

| | | | | |
|---|---|---|---|---|
| 1,639,495 | A | 8/1927 | Frame | |
| 2,593,918 | A | 4/1952 | Redman | |
| 3,629,981 | A | 12/1971 | McCaffery | |
| 3,926,533 | A | 12/1975 | Binette | |
| 4,121,390 | A | 10/1978 | Hall et al. | |
| 4,187,647 | A | 2/1980 | Hall | |
| 4,188,151 | A | 2/1980 | Hall | |
| 4,236,358 | A | 12/1980 | Bowman | |
| 4,408,421 | A | 10/1983 | Pai | |
| 4,469,467 | A | 9/1984 | Odill et al. | |
| 4,582,450 | A | 4/1986 | Neil | |
| 4,690,584 | A | 9/1987 | LeBaron | |
| 4,834,574 | A | 5/1989 | Bowman | |
| 5,030,030 | A | 7/1991 | Simmonds | |
| 5,051,022 | A | 9/1991 | Bowman | |
| 5,201,600 | A * | 4/1993 | Topf et al. | 404/25 |
| 5,205,668 | A | 4/1993 | Adams | |
| 5,209,601 | A | 5/1993 | Odill et al. | |
| 5,221,155 | A | 6/1993 | Neil | |
| 5,482,400 | A | 1/1996 | Bavington | |
| 5,531,485 | A | 7/1996 | House et al. | |
| 5,536,110 | A | 7/1996 | Tompkins et al. | |
| 5,564,855 | A | 10/1996 | Anderson | |

(Continued)

FOREIGN PATENT DOCUMENTS

| | | |
|---|---|---|
| DE | 2525285 | 12/1976 |

(Continued)

*Primary Examiner*—Raymond W Addie
(74) *Attorney, Agent, or Firm*—Reising, Ethington, Barnes, Kisselle, P.C.

(57) ABSTRACT

A stackable polymeric foam adjustment or grade ring is provided for the construction of the adjustment courses or manhole chimney portion of a sewer system. The adjustment ring is circular and may include concentric annular grooves on at least one surface and male portions corresponding in size and shape to the concentric annular grooves on a second surface. The adjustment rings are stacked one on another with the respective male portions being coupled within a corresponding annular groove to provide a manhole construction that is resistant to inflow, chemicals and freeze-thaw cycle damage.

12 Claims, 2 Drawing Sheets

U.S. PATENT DOCUMENTS

| | | | |
|---|---|---|---|
| 5,595,455 | A | 1/1997 | Svirklys |
| 5,702,200 | A | 12/1997 | Hawkins |
| 5,769,564 | A | 6/1998 | Hawkins |
| 5,876,533 | A | 3/1999 | House et al. |
| 5,899,024 | A | 5/1999 | Stannard |
| 5,956,905 | A | 9/1999 | Wiedrich |
| 6,196,760 | B1 | 3/2001 | Sinclair |
| 6,514,008 | B1 * | 2/2003 | Smolnik ..... 405/26 |

FOREIGN PATENT DOCUMENTS

| | | |
|---|---|---|
| GB | 2088446 | 6/1982 |
| GB | 2102479 | 2/1983 |
| GB | 2270708 | 3/1994 |

* cited by examiner

CONSTRUCTION OF A FOAMED POLYMERIC MANHOLE CHIMNEY

CROSS REFERENCE TO RELATED APPLICATION

The present invention claims priority from U.S. Provisional Application Ser. No. 60/610,577 filed Sep. 16, 2004, and entitled "Construction of a Foamed Polymeric Manhole Chimney."

TECHNICAL FIELD AND INDUSTRIAL APPLICABILITY OF THE INVENTION

The present invention relates to a construction of a manhole chimney. More specifically, the present invention relates to a foamed polymeric adjustment or grade ring that is used to construct the manhole chimney.

BACKGROUND OF THE INVENTION

Generally, the construction of a manhole includes an underground horizontal main sewer line having vertical access pipes or sections connected to the main sewer line which lead to a truncated cone and ultimately to a manhole frame and cover. On top of the cone a manhole chimney or adjustment courses are constructed which lead upward and are of the same diameter as the upper surface of the cone. The manhole frame is placed on top of this chimney and holds the manhole cover.

Past constructions of the manhole chimney or adjustment courses included using brick and mortar to build up the manhole chimney or in the alternative precast concrete rings have been used which are stacked on top of one another. The state of the art is generally shown in the following cited references: U.S. Pat. No. 1,639,495 issued to Frame; U.S. Pat. No. 3,926,533 issued to Binette; German Patent No. 2,525,285; U.S. Pat. No. 4,121,390 issued to Hall; U.K. Patent No. 2,088,446; U.K. Patent No. 2,102,479, U.S. Pat. No. 4,408,421 issued to Pai; and U.S. Pat. No. 4,469,467 issued to Odill, et al.

Upon completion of the construction, the surrounding surface is back filled, and the upper surface is paved such that the manhole is generally flat with the surrounding roadway surface. In areas other than streets the top of the cover is also generally adjusted to the surrounding ground level.

Because of the numerous and varying stresses on these constructions, manhole chimney constructions of the past have been prone to rapid deterioration. For instance, the hydrogen sulfide gas and other chemicals commonly found in sewer systems, may be corrosive to cement and may tend to deteriorate the preformed rings or the cement that holds the brick constructions together. In addition, the freeze-thaw cycles of the surrounding ground place strong pressure on the construction and may crush the construction. These freeze-thaw cycles may also work to widen any cracks or deformations in the structure thereby breaking down the structure. Also jolts or shock waves produced by passing traffic and road scrapers accentuate the destructive forces acting on the construction thereby breaking down the construction even sooner. Because of these and other problems the integrity of the structure is eventually broken such that water and sediment may be permitted to flow through the manhole chimney and into the sewer system.

This process is called inflow and is undesirable in a sewer system in that these sediments may cause clogging of the sewer system or create undesirable conditions for workers working inside the sewer system. In addition, inflow may soon result in a void in the underlying support of the roadway surface were the sediment has entered through the breaches in the manhole chimney, which may then cause structural problems with the roadway surface since it is not supported where the void occurs.

The precast spacing rings of the past have also been troublesome to install in a manhole chimney. These precast rings are heavy and require heavy equipment or several men to install. In addition these rings tend to be somewhat fragile and may shatter or crack if dropped or mishandled.

In the past, constructions have been attempted wherein seals have been placed between the precast ring in an attempt to stop the inflow problem. In addition, as disclosed in U.S. Pat. No. 4,469,467 issued to Odill and assigned to Cretex Companies, manhole chimney seals have been attempted which seal the manhole chimney by a rubber tubular seal placed either on the inside or the outside of the manhole chimney. However, these constructions may still allow freeze-thaw damage or other damage to the chimney construction to occur.

SUMMARY OF THE INVENTION

The present invention provides an adjustment ring, or grade ring, for use in a construction of a manhole chimney that includes at least one continuous polymeric foam grade ring coated with a weatherable and strength enhancing coating that can be stacked one on another for providing a construction of the chimney portion of a sewer system.

It is an object of the present invention to provide a chimney construction which is free from inflow and which is resistant to chemicals, freeze-thaw damage, inflow, and which will absorb road shock from passing automobiles and road scrapers and retain its structural integrity.

It is a further object of the present invention to provide a lightweight yet rigid and durable adjustment ring for use in the construction of a manhole chimney and which will provide economical installation and would not be prone to damage from mishandling or dropping of the ring.

Other objects and advantages of the present invention will become apparent upon considering the following detailed description and appended claims, and upon reference to the accompanying drawings.

DETAILED DESCRIPTION AND PREFERRED EMBODIMENTS OF THE INVENTION

Figure 1:
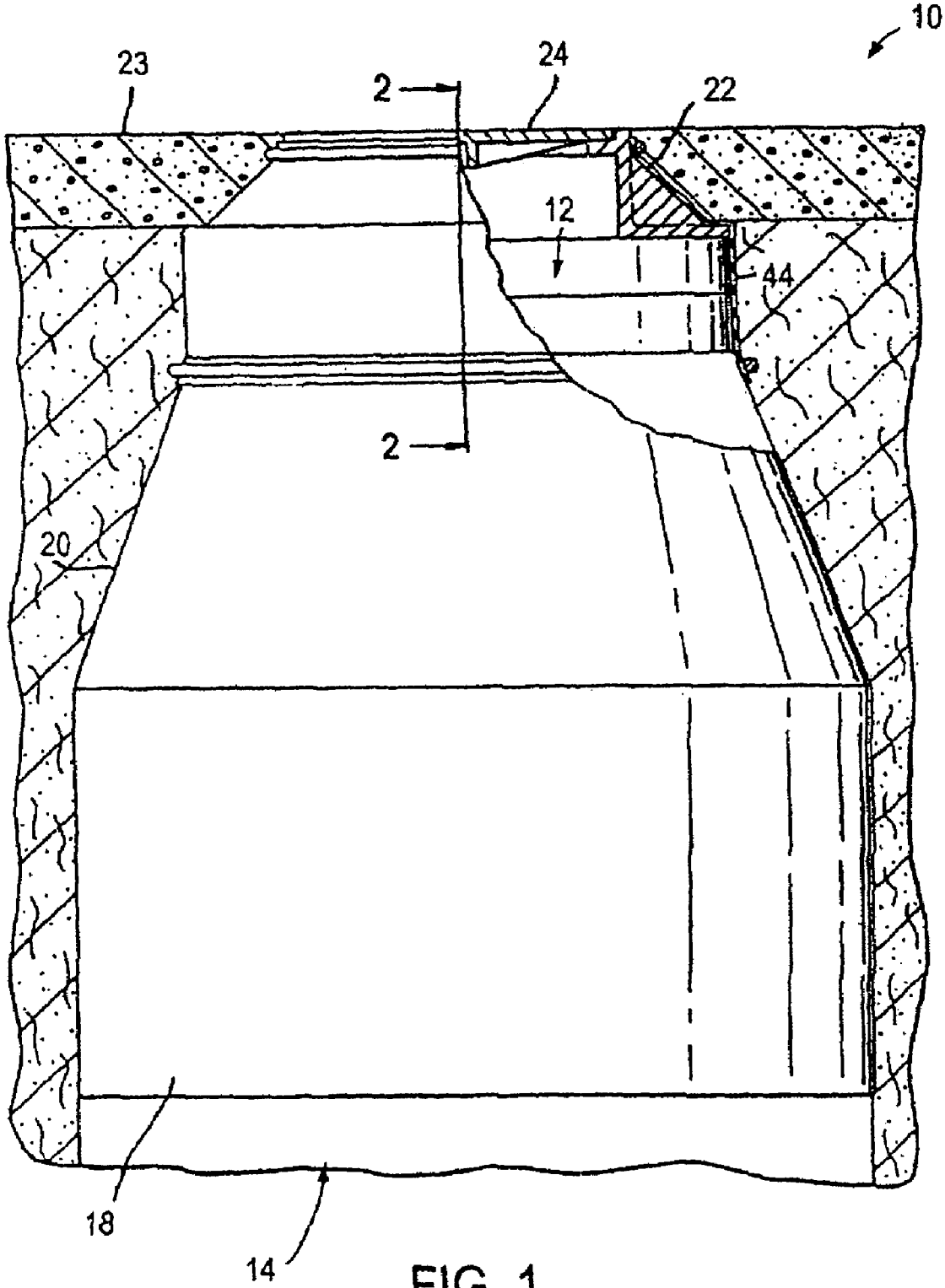
FIG. 1 is an overall view partially broken away of a manhole chimney construction of the present invention.

According to the present invention, there is provided an adjustment ring, or grade ring, for use in the construction of a manhole chimney assembly, generally indicated as 10. More specifically, continuous polymeric foam grade rings 12 are provided for stacking one on another, thus providing a construction of the chimney portion of a manhole access to a sewer system 14.

The sewer system 14 includes a main sewer line (not shown) that has vertical access pipe or riser 18 rising from it and leading to a cone 20. The invention of the chimney assembly 10 is generally constructed on top of the cone 20. In the present invention the continuous polymeric foam construction rings 12 are stacked one on another, and the frame 22 of the manhole cover 24 is placed on top of the uppermost polymeric foam construction ring 12. The number of rings 12 and thickness of the rings may vary depending upon the application. Rings 12 are preferably formed at thicknesses including but not limited to one-half inch, one inch, two inches, four inches and six inches.

Figure 5:
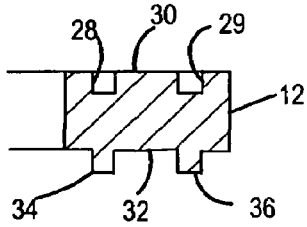
FIG. 5 is a cross sectional view of an embodiment of the elastomeric ring of the present invention.

Referring now to FIG. 5, in one preferred embodiment of the present invention, the continuous polymeric foam construction grade rings 12 are formed having an upper surface 30 and a lower surface 32, with the upper surface 30 including annular grooves 28, 29 and the lower surface 32 including male portions 34, 36 that correspond in size and shape with the respective grooves 28, 29. It is preferable that the upper surface 30A of the topmost ring 12A contains no grooves 28, 29 to provide an increased seal to the manhole frame 22. Further, it is preferably that the lower surface 32A of the bottommost ring 12B contain no male portions 34, 36, thus providing an increased seal between the bottommost ring 12B the cone 20.

When the one or more polymeric foam rings 12 are placed on top of the cone 20 of a sewer system 14 initially a layer of mastic may be placed between the cone 20 and the bottommost ring 12B. Thereafter, the polymeric foam rings 12 are stacked one upon another with the male portions 34, 36 positioned within the respective annular grooves 28, 29 between adjacent rings 12 until the level of the upper surface of the manhole frame 22 is even with the roadway surface 23 or ground level. The manhole frame 22 is then placed on top of the topmost construction ring 12A that is then back filled and paved around, thereby holding the frame 22 in place.

Figure 3:
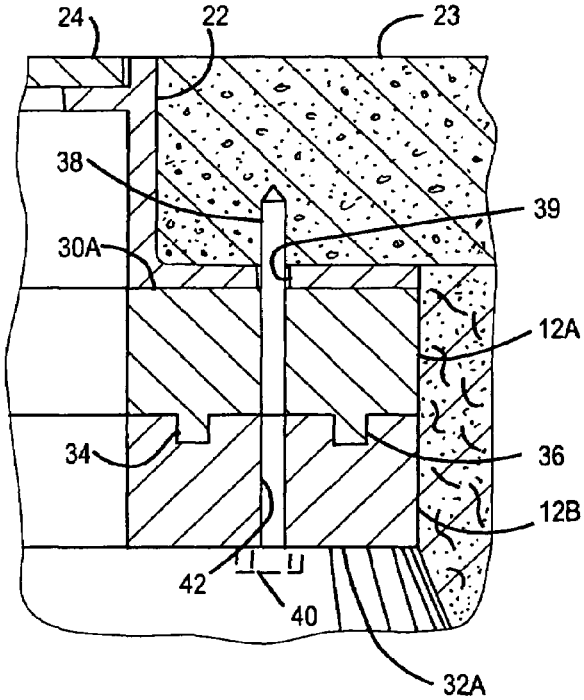
FIG. 3 is a detailed cross sectional view of an alternate construction of a manhole chimney of the present invention.

Optionally, as shown in FIG. 3, mollies 38 are provided in the cone 20, and the frame 22 has corresponding holes 39 that would allow bolts 40 to secure the system together. Therefore, the polymeric foam rings 12 may be accompanied by a series of aligned vertical holes 42 through which bolts 40 are placed to hold the frame 22 onto the cone 20.

Figure 6:
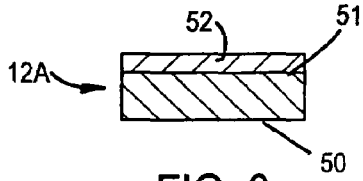
FIG. 6 is a cross section view of an embodiment of the elastomeric construction ring of the present invention.

As shown best in FIG. 6, the polymeric foam rings 12A, 12 and 12B (Ring 12A is represented in FIG. 6) of the present invention, as described above, have a polymeric foam core 50 having suitable strength, flexibility and durability for use in the construction industry. The polymeric foam rings 12 are lightweight and thus are easy to transport and assemble. The polymeric foam core of the rings 12 is formed in any number of processes well known to those of ordinary skill in the art of forming foam materials. Thus, techniques such as open pour molding, casting, or injection molding may be utilized.

A polymeric coating 52 is applied to the entire outer surface 51 of the core 50 to act as a barrier layer and to enhance the mechanical properties of the rings 12. As such, the polymeric foam rings are structurally sound, absorb shock, and are generally impervious to sulfides and other gases found in a sewer system. Further, the polymeric foam rings 12 are freeze-thaw cycle resistant.

The polymeric foaming material used in the core 50 selected should be at least substantially chemically inert, in its final state, and resistant to oxidation, acids, alkalis, salts and petroleum, vegetable and/or animal based oils, fats and greases. It should be particularly resistant and impermeable to sewage liquid and gases, particularly sulfides typically present in such gases, and should further be nonconducive to bacterial or fungal growth. The polymeric foam material must maintain all of these properties within a large temperature range.

One preferred polymeric foaming material suitable for use in the core 50 is polyurethane foam, as the cured foam is impermeable to liquids and gases, corrosive resistant, and expands to fill any holes, crevices or irregularities during the molding process.

The polymeric foam core 50 may also be preferably formed from alkenyl aromatic resins, such as polystyrenic resin(s), and polyesters such as polyethylene terephthalates. The term "alkenyl aromatic polymer" as used herein includes polymers of aromatic hydrocarbon molecules that contain an aryl group joined to an olefinic group with only double bonds in the linear structure. The polymeric foam core 50 may also be made from polyolefinic resins such as low-density polyethylene (LDPE), high-density polyethylene (HDPE), and ultra low-density polyethylene (LLDPE), and the like. The polystyrenic resins include impact polystyrenes such as medium impact polystyrene and high impact polystyrene. Other resins that may also utilized as the polymeric foaming material include expanded polypropylene or expanded polyethylene Most preferably, expanded polystyrene ("EPS") having a density of about 4.5 pounds per cubic square foot is utilized as the polymeric foam core 50 material. However, a density range of between about 2.0 and 5.0 pounds per cubic square feet is specifically contemplated.

In addition to the core resins listed above, the polymeric foam core 50 may also consist of other materials commonly used in foamed products, including but not limited to fillers, additives, and mold release agents.

Further, a blowing agent is typically introduced to the resin core to form the polymeric foam. This blowing agent can be in the form of a gas, which is injected into an injection-molding machine, along with the polymeric foaming material. Alternatively, the blowing agent may be in the form of a dry powder. When the polymeric foaming material and blowing agent are introduced to a mold (casting mold or open pour mold), the heat of the melted plastic causes the blowing agent to react, which forms a gas, which in turn foams the polymeric foaming material within the mold.

The coating layer 52 should be compatible with the underlying core material, and additionally be substantially impermeable to liquids and gases and be substantially corrosive and otherwise weather resistant. The coating layer 52 preferably forms a substantially continuous layer on top of the core 50 and also preferably strengthens the underlying foam core 50.

One preferred coating useful with polymeric foam cores 50 is polyurea coating having a dry film thickness of about 15 mils. However, other types of coating materials compatible with the foam core material and providing the required corrosive and weather resistant properties may also be used and fall within the spirit of the present invention.

To form a coating 52 on the surface 51 of the polymeric foam core 50, and number of techniques well known in the art may be used. As is common with most techniques, the surface 51 of the foam core 50 is first cleaned of any dirt or mold release agents. Next, the coating material 52 is applied in any number of fashions to the desired thickness, including but not limited to spray, roller, or dipping applications.

Thus a construction is provided wherein the chimney portion 10 of a manhole is substantially impervious to inflow damage from freeze-thaw cycles, and damage from shocks of vehicles and scrapers.

Figure 2:
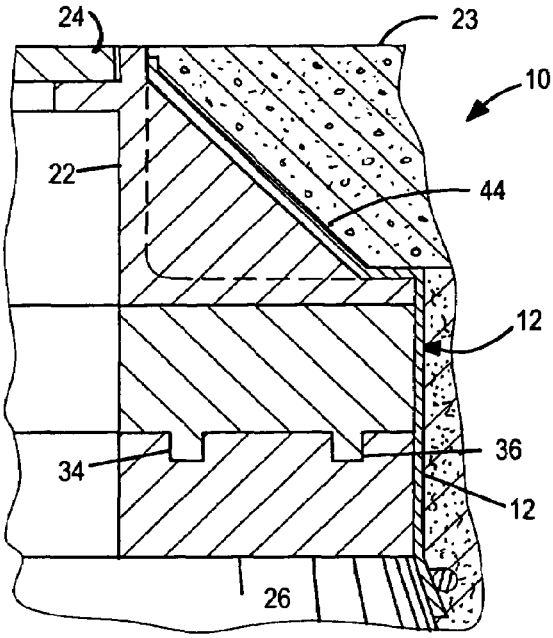
FIG. 2 is a detailed cross sectional view of the elastomeric ring construction of a manhole chimney, of the present invention.
Figure 4:
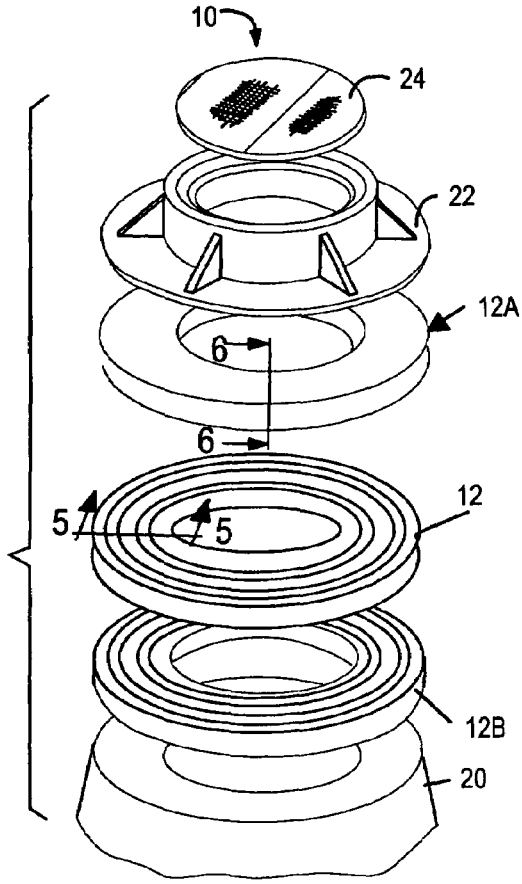
FIG. 4 is an exploded view of a manhole chimney construction of the present invention.

Also provided in one form of the present invention is a polymeric coating 44 that may be used in particularly harsh climates to further seal the construction from inflow and other types of damage. The polymeric coating 44, as shown in FIG. 2, is introduced entirely around the outer periphery, or along certain portions of the outer periphery, as desired Thus, the present invention may be practiced with or without the coating 44 depending on the location of the manhole and the surrounding conditions.

As will be appreciated to those skilled in the art the manhole chimney construction 10 of the present invention may be used during initial construction of a sewer system 14. Also, the construction of the present invention may be readily used to replace existing constructions or those that have been damaged. In addition, the material is lightweight and easily transported and installed.

While the invention has been described in terms of preferred embodiments, it will be understood, of course, that the invention is not limited thereto since modifications may be made by those skilled in the art, particularly in light of the foregoing teachings.

What is claimed is:

1. In a manhole assembly having a longitudinally upper frame portion disposed on a longitudinally lower cone portion, an improved structure for substantially preventing inflow of water or other material between the upper frame portion and the lower cone portion, the improvement comprising:

a plurality of continuous and compressible polymeric foam construction grade rings serially stacked longitudinally and laterally aligned with one another between the upper frame portion and the lower cone portion, one of said grade rings being sealingly secured to the frame portion and another of said grade rings being sealingly secured to the cone portion, a longitudinally adjacent pair of said grade rings having generally flat sides longitudinally confronting one another;

wherein said generally flat side of one of said longitudinally adjacent pair of said grade rings is formed having at least a pair of laterally spaced concentric annular grooves and wherein said generally flat side of an other of said longitudinally adjacent pair of grade rings is formed having a male portion corresponding in size and shape to a respective one of said laterally spaced concentric annular grooves, wherein said respective male portion of said other of said longitudinally adjacent pairs of said grade rings is coupled within a respective one of said pair of laterally spaced annular grooves of said one of said longitudinally adjacent pair of said grade rings; and wherein at least one of said plurality of continuous and compressible continuous polymeric foam construction grade rings comprises:

a polymeric foam core having an outer surface; and a polymeric coating applied to said outer surface.

2. The manhole assembly according to claim 1, wherein said polymeric foam core is selected from the group consisting of a polyurethane foam core, an alkenyl aromatic resin foam core, a polyester foam core, a polyethylene foam core, a polypropylene core and a polystyrene foam core.

3. The manhole assembly of claim 2, wherein said polyethylene foam core is selected from the group consisting of a low density polyethylene foam core, a high density polyethylene foam core, and an ultra low density polyethylene foam core.

4. The manhole assembly of claim 2, wherein said polystyrene foam core is selected from the group consisting of an expanded polystyrene core, a medium impact polystyrene foam core and a high impact polystyrene foam core.

5. The manhole assembly of claim 1, wherein said polymer coating comprises a polyurea coating.

6. A method for forming a manhole chimney assembly, the method comprising:

providing a longitudinally upper frame portion disposed on a longitudinally lower cone portion;

forming a plurality of continuous and compressible continuous polymeric foam construction grade rings, wherein one of said plurality of grade rings is formed having at least a pair of laterally spaced concentric annular grooves and wherein another one of said grade rings is formed having a male portion corresponding in size and shape to each respective one of said at least a pair of laterally spaced concentric annular grooves; and stacking at least two of said plurality of continuous and compressible continuous polymeric foam construction grade rings between said upper frame portion and said longitudinally lower cone portion such that each respective pair of said at least two of said plurality of continuous and compressible continuous polymeric foam construction grade rings is serially stacked longitudinally and laterally aligned with respect to one another, one of said grade rings being sealingly secured to the frame portion and another of said grade rings being sealingly secured to said cone portion, wherein a male portion of one of said at least two grade rings is coupled within a corresponding concentric annular groove of an adjacent one of said at least two grade rings; and wherein forming a plurality of continuous and compressible continuous polymeric foam construction grade rings comprises:

forming a polymeric foam core having an upper surface and a lower surface; and applying a polymeric coating layer to a desired film thickness on an outer surface of said polymeric foam core.

7. The method of claim 6, wherein forming a polymeric foam core comprises:

selecting a polymeric foaming material and a blowing agent;

providing a foaming device shaped to substantially match the shape of the construction ring, said foaming device selected from the group consisting of an injection-molding machine, a cast, and an open pour mold;

introducing said polymeric foaming material and said blowing agent within said foaming device;

forming said polymeric foam core within said foaming device from said polymeric foaming material and said blowing agent, said polymeric foam core having an upper surface and a lower surface, said upper surface and said lower surface each having a concentric groove; and removing said polymeric foam core from said foaming device.

8. The method of claim 7, wherein selecting a polymeric foaming material comprises selecting a polymeric foaming material from the group consisting of a polyurethane foaming material, an alkenyl aromatic resin foaming material, a polyester foaming material, a polyethylene foaming material, a polypropylene foaming material and a polystyrene foaming material.

9. The method of claim 6, wherein applying a polymeric coating layer comprises applying a polyurea coating layer to said polymeric foam core at a dry thickness of about 15 mils.

10. The method of claim 6, wherein a topmost one of said at least two continuous and compressible continuous polymeric foam construction grade rings between said upper frame portion and said longitudinally lower cone portion is formed having a substantially flat upper surface and having a lower surface having at least two of said male portions, said upper surface being closely coupled to said upper frame portion.

11. The method of claim 6, wherein a bottommost one of said at least two continuous and compressible continuous polymeric foam construction grade rings between said upper frame portion and said longitudinally lower cone portion is formed having a substantially flat lower surface and having an upper surface having at least a pair of laterally spaced concentric annular grooves, said lower surface being closely coupled to said longitudinally lower cone portion.

12. The method of claim 6, wherein at least one of said plurality of continuous and compressible continuous polymeric foam construction grade rings is formed having a first surface including at least a pair of laterally spaced concentric annular grooves and a second surface having a male portion corresponding in size and shape to each respective one of said at least a pair of laterally spaced concentric annular grooves, said first surface being opposite said second surface.

* * * * *